US005422142A

United States Patent [19]

Hsu

[11] Patent Number: 5,422,142

[45] Date of Patent: * Jun. 6, 1995

[54] PROCESS FOR MAKING ELECTROLESS PLATED ARAMID FIBRIDS

[75] Inventor: Che-Hsiung Hsu, Wilmington, Del.

[73] Assignee: E. I. du Pont de Nemours and Company, Wilmington, Del.

[ * ] Notice: The portion of the term of this patent subsequent to Apr. 12, 2011 has been disclaimed.

[21] Appl. No.: 226,124

[22] Filed: Apr. 11, 1994

Related U.S. Application Data

[63] Continuation-in-part of Ser. No. 987,898, Dec. 8, 1992, Pat. No. 5,302,415.

[51] Int. Cl.[6] ..... B05D 1/18; B05D 3/10

[52] U.S. Cl. ..... 427/306; 427/304; 427/305; 427/316; 427/443.1

[58] Field of Search ..... 427/304, 305, 306, 316, 427/443.1

[56] References Cited

U.S. PATENT DOCUMENTS

| | | | |
|---|---|---|---|
| 3,686,017 | 8/1972 | Merikhein et al. | 427/304 |
| 4,634,805 | 1/1987 | Orban | 174/128 R |
| 4,985,046 | 1/1991 | Hartzler | 8/654 |
| 5,302,415 | 4/1994 | Gabara | 427/306 |

FOREIGN PATENT DOCUMENTS

| | | |
|---|---|---|
| 1081072 | 12/1954 | Germany . |
| 1235002 | 5/1960 | Germany . |
| 2820502A1 | 11/1979 | Germany . |
| WO90/00634 | 1/1990 | WIPO . |

*Primary Examiner*—Roy V. King

[57] ABSTRACT

A process is disclosed for making metal plated fibrids wherein the plating is conductive and highly durable. The process involves contacting the fibrids with an 80 to 90% sulfuric acid solution, neutralizing and washing the fibrids with water, and then plating the fibrids by an electroless plating process. The acid treatment of the fibrids promotes adhesion between the metal and the fibrids and promotes high electrical conductivity for the plated metal.

12 Claims, No Drawings

PROCESS FOR MAKING ELECTROLESS PLATED ARAMID FIBRIDS

RELATED U.S. APPLICATION DATA

This is a continuation-in-part of Ser. No. 987,898, filed Dec. 8, 1992, now U.S. Pat. No. 5,302,415.

BACKGROUND OF THE INVENTION

1. Field of the Invention

This invention relates to electroless metal plating of aramid fibrids, and of papers and sheets containing aramid fibrids, wherein the metal is strongly adhered to the fibrid and provides a highly conductive surface. The aramid fibrids are subjected to a preplating treatment including carefully controlled exposure to a concentrated sulfuric acid solution, followed by washing, and the electroless plating, itself.

2. Description of the Prior Art

Electroless plating is the deposition of a metal film by interaction of metal ions and a chemical reducing agent in a basic solution. Electroless plating, in a general way, is well known. One of the difficulties in achieving successful electroless plating has resided in obtaining good adhesion between the plating substrate and the plated metal. While mere encapsulation may suffice for some applications and some articles, good adhesion of the plated metal is essential for most uses. In the present invention, the plated metal coating on sheets and the materials used to make sheets must be durable enough to withstand the forces of further processing and end use stresses.

Aramid fibers in the form of staple, floc, pulp, and the like and aramid fibrids are known to be useful in constructing sheets and papers. Electroless plating of such materials has, in the past, resulted in metal coatings which exhibited poor adhesion between the surface of the material and the metal.

SUMMARY OF THE INVENTION

The present invention provides a process for plating aramid fibrids, and papers and sheets containing aramid fibrids, with a durable metal coating comprising the steps of contacting aramid fibrids, and sheets and papers containing aramid fibrids, in an 80 to 90% sulfuric acid solution for at least 2 seconds at a temperature in the range from 10 to 50 C., neutralizing and washing the acid-soaked fibrids with water until substantially all of the acid is removed, and plating the fibrids by an electroless plating process.

For plating the fibrids with copper, the electroless plating process is conducted by contacting the acid-treated and washed fibrids with a tin-palladium sensitizing solution, rinsing the fibrids in water to remove non-adherent sensitizing solution, optionally, immersing the rinsed fibrids in an aqueous accelerator solution of mineral acid to remove excess tin ions, and then immersing the fibrids in an electroless copper plating bath.

For plating the fibrids with silver, the electroless plating process is conducted by contacting the acid-treated and washed fibrids with a stannous ion sensitizing solution, rinsing the fibrids in water to remove non-adherent stannous ions, immersing the rinsed fibrids in an aqueous solution of silver cations to be reduced by the stannous to silver metal for activating the polymer surface, followed by adding a reducing agent to the aqueous solution of silver cations to promote preferential deposition of silver on the silver-activated surface.

In practice of the present invention, it is preferred that the activating metal for copper or nickel plating is palladium; and, for silver, the activator is silver, itself. The preferred aramid is poly(meta-phenylene isophthalamide).

DETAILED DESCRIPTION OF THE INVENTION

There has long been a need for conductive aramid fibrids, and sheets and papers comprising aramid fibrids, which have durable metallic coatings. Such articles are useful, for example, in electromagnetic shielding.

Aramid fibrid substrate surface treatments and pretreatments in preparation for plating have, generally, up to now, not been entirely satisfactory.

This invention provides a process for electrolessly plating fibrids of aramids at substantially increased plating rates and in a way that yields plated fibrids, and sheets and papers comprising fibrids, having a metal coating which is highly conductive and strongly adherent. The process can be conducted on a continuous basis or batch-wise. For the purpose of describing this invention, the word "fibrids" should be understood to, also, include sheets and paper containing fibrids. Such sheets and papers can be made using a combination of fibrids with aramid fibers, pulps, or flocs in accordance with known papermaking practices.

By "aramid" is meant a polyamide wherein at least 85% of the amide (—CO—NH—) linkages are attached directly to two aromatic rings. Suitable aramids are described in Man-Made Fibers—Science and Technology, Volume 2, Section titled Fiber-Forming Aromatic Polyamides, page 297, W. Black et al., Interscience Publishers, 1968. Aramids are also disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid.

Meta-aramids are the primary aramids for use in the fibrids of this invention and poly(m-phenylene isophthalamide) (MPD-I) is the preferred meta-aramid. By MPD-I is meant the homopolymer resulting from mole-for-mole polymerization of m-phenylene diamine and isophthaloyl chloride and, also, copolymers resulting from incorporation of small amounts of other diamines with the m-phenylene diamine and of small amounts of other diacid chlorides with the isophthaloyl chloride. As a general rule, other diamines and other diacid chlorides can be used in amounts up to as much as about 10 mole percent of the m-phenylene diamine or the isophthaloyl chloride, or perhaps slightly higher, provided only that the other diamines and diacid chlorides have no reactive groups which interfere with the polymerization reaction. MPD-I, also, means copolymers resulting from incorporation of other aromatic diamines and other aromatic diacid chlorides, provided, only that the other aromatic diamines and aromatic diacid chlorides be present in amounts which do not interfere with the desired performance characteristics of the aramid.

Fibrids are known, for example, from U.S. Pat. No. 2,999,788, U.S. Pat. No. 3,756,908, U.S. Pat. No. 4,472,241, and U.S. Pat. No. 5,026,456. Fibrids of MPD-I can be prepared by precipitation of a solution of the polymer using a non-solvent under conditions of very high shear.

Fibrids from meta-aramids can be combined with fibers, pulps, or flocs of meta-aramids or para-aramids to form sheets or papers. Aramid sheets and papers are known, for example, from U.S. Pat. No. 3,756,908, U.S. Pat. No. 5,026,456, U.S. Pat. No. 4,515,656, Research Disclosure No. 18823 (December 1979, Kenneth Mason Publications Ltd.).

Para-aramids are useful as fibers, pulps or flocs for sheets or papers of this invention and poly(p-phenylene terephthalamide) (PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

As a first step in the process of this invention, the aramid fibrids to be plated, are contacted with sulfuric acid at a concentration of 80 to 90%, preferably between 80 to 88%. At sulfuric acid concentrations above 90%, the solvating power of the acid is too high, causing damage to the fibrids. At sulfuric acid concentrations below 80%, the treatment time is excessively lengthened and no longer practical.

The temperature of the sulfuric acid bath should be in the range from 10 to 100 C. and preferably about 20 C. to 40 C. The upper temperature limit is governed by the adverse effect on the properties of the fibrids, whether or not included in sheets or paper, while the lower temperature limit is a matter of practicality; lower temperatures requiring unacceptably long times for adequate treatment.

The fibrids are contacted with the acid solution for at least 2 seconds. With shorter exposure times it is difficult, ultimately, to achieve satisfactory depth of treatment. As a general rule, contacting the fibrids with the acid for more than 60 seconds, even at moderate temperatures, results in degradation of the fibrids. The preferred contact time is about 5–30 seconds. The necessary contact time with the acid can be reduced by increasing the temperature and/or increasing the acid concentration. Effective practice of the process of this invention requires a reasonable combination of acid concentration, temperature, and soaking time. Table I and Table II herein contain some combinations of time, temperature, and acid concentration useful for the practice of this invention.

The acid contacted fibrids are washed well with water to remove substantially all of the sulfuric acid. Optionally, the fibrids can be neutralized with a base such as sodium bicarbonate solution which can be added to the wash water or used in a separate step. It is, also, possible to dry the acid-contacted fibrids prior to the plating step.

The kernel of this invention resides in the discovery that aramid fibrids treated with acid as prescribed herein, can yield an improved metal-plated product.

As a general rule, well-known electroless metal plating processes can be used to plate the aramid fibrids after acid treatment in accordance with the present invention.

For an example of a copper plating process, an aqueous sensitizing solution, sometimes known as an activation bath is prepared using palladium and tin cations as activation catalyst. The acid-contacted and washed aramid fibrids to be plated are immersed in the bath and agitated to promote activation of the fibrid surfaces. The fibrids are, then, removed from the activation bath and rinsed and may, if desired, be transferred to an accelerator bath of dilute mineral acid.

The fibrids are then placed in, or conducted through, a plating bath with copper ions and formaldehyde wherein the copper ions are complexed to maintain solution, for example, with tetrasodium salt of ethylenediamine tetraacetic acid (EDTA).

Baths having a wide range of metal concentrations can be used in practice of this invention. The preferred plating baths are from about 1 to 5 grams per liter of copper. In tests described herein, baths of 15 to 3 grams per liter of copper are most preferred.

The plating bath, with immersed activated fibrids is moderately agitated for 10 to 20 minutes to assure adequate pick-up. Formaldehyde, pH-adjusting caustic solution, and copper ion solution are added at the rate of depletion. Additions can be made continuously or intermittently. The plated material can then be rinsed and dried. Instead of formaldehyde, other materials can be used as reducing agents. Among the eligible reducing agents are hypophosphite, hydrazine, boron hydride, and the like.

All of the above steps can be conducted with the various baths at temperatures of 10 to 60 C., and preferably 20–40 C.

For an example of a silver plating process, the acid-contacted fibrids are first immersed in an aqueous sensitizing solution, sometimes known as a reducing agent solution such as $SnCl_2/HCl$. The $SnCl_2$-immersed fibrids are rinsed with water extensively to remove excess stannous ions and are then transferred to an aqueous bath to which is added a metal complex solution of silver nitrate and ammonia at a bath pH of 8–9.5. During immersion in the metal complex bath, the bath is agitated to ensure that imbibed stannous ions reduce silver ions to silver metal on the polymer surface. Formaldehyde is added to the metal complex solution as a reducing agent and silver ions preferentially deposit on the silver-activated polymer surface. In a typical process, the molar ratio of formaldehyde/silver is from 1.1/1 to 2/1. The amount of silver nitrate is adjusted to provide the desired weight of reduced silver as a function of the material to be plated. The silver-plated fibrids are rinsed and dried.

For the purpose of describing this invention, the activation solution of tin-palladium for copper plating and the reducing solution of stannous ion for silver plating shall be known as sensitizing solutions. The sensitizing solutions are used in electroless plating to promote preferential metal deposition onto the desired surfaces.

Instead of silver or copper, nickel or cobalt or the like can be, also, plated on the acid-contacted fibrids with a proper combination of sensitizing solution, reducing agent solution, and metal plating solution.

The plating processes can be conducted on acid-contacted fibrids which have been dried or which remain wet from the acid-contacting step. In the case of copper plating, the plating quality appears to be relatively unaffected by drying after acid contact. However, the silver plating process appears to yield plated silver of the lowest resistance when the fibrids are dried at about 15–80 C, preferably at 15–20 C. to a moisture content of less than 20 weight percent and preferably less than 10 weight percent. When the fibrids to be silver plated are dried at moderate temperature, there appears to be better continuity of silver coating than is realized with drying at higher temperatures.

Test Methods

Electrical resistance:

Electrical resistance of metal-plated aramid sheets or paper at ambient conditions is determined by a four probe method. The plated aramid sheet or paper is cut to a rectangle of about 0.8 cm in width and about 55 cm in length. Four metal pressure clips are mounted on the specimen across the width direction in four different sections. The metal clip consists of two flat metal pieces which are spring-loaded against each other. The cut specimen is inserted between the two metal pieces to ensure electrical contact. The two outer metal clips are then connected to a electrical current supply whereas the two inner metal clips separated by about 25 cm are connected to an electrometer. Corresponding voltages from known currents applied to the two outer metal clips are then used for calculation of electrical resistance based on Ohm's law. The calculated resistance is then normalized to the resistance corresponding to 0.8 cm(width)×25 cm(length) dimension. The normalized resistance values are listed in the Tables for comparison.

Tensile Test:

Tensile breaking strength/Elongation/Modulus (T/E/M) of aramid paper are determined, according to ASTM 828, at 2 inch gauge length and are reported in lb/inch for T, kpsi for M, and in % for E. The tensile test is carried out to determine the effect of aqueous $H_2SO_4$ treatment.

Metal adhesion test:

A piece of 3M Scotch brand MagicR tape is first adhered to a metal-plated aramid paper. The tape is rubbed very hard against the metal-coated paper by thumb three times. The tape is then pulled away from the paper and is examined visually to determine whether or not metal on the paper was peeled off onto the tape.

EXAMPLE 1

Aqueous $H_2SO_4$ treatment: Pieces (~35 cm×~55 cm each) of meta-aramid paper (2 mil thick, containing 52 weight percent meta-aramid fibrids and 48 weight percent meta-aramid floc) were first contacted with various concentrations of sulfuric acid for various times at 20° C. The concentrations and times are listed in Table I. The paper pieces were stirred vigorously during the immersion in the acid solutions. The acid-contacted papers were washed with water for half an hour. Water was changed twice during the washing. The papers were then immersed in an 8 weight percent sodium bicarbonate solution for half an hour followed by further washing with water for half an hour. The papers were then thoroughly dried in a vacuum oven before being weighed for determination of nickel percentage after nickel plating.

Nickel plating

The acid-contacted aramid paper samples and one untreated sample were nickel-plated according to the following steps:

1) Immersed in a palladium catalyst kept at 40° C. for 10 minutes. The palladium catalyst was made by mixing 540 g Shipley Co. CataprepR 404, 60 ml Shipley Co. CatapositR 44 and 1,700 ml deionized water to sensitize the fibrids.
2) The sensitized fibrids were then nickel-plated in a nickel-plating solution for 20 minutes at room temperature. The nickel plating solution was made by mixing 38.02 g nickelous chloride hexahydrates, 16.96 g sodium hypophosphite monohydrate, and 753.3 g deionized water. 40.4 g 30% ammonia solution was then slowly added to the mixture and stirred for about half an hour.
3) The nickel-plated fibrids were washed with water for about one and one-half hours. Water was changed twice. The thoroughly washed samples were then dried in a vacuum oven for about 24 hours. Each sample was weighed and the weights were compared with the weights prior to the nickel plating for determination of nickel weight percentage in each nickel-plated sample. The nickel-plated samples were tested for electrical resistance, and nickel adhesion to the paper substrate.

Results are listed in Table I. The results show that aramid papers contacted with an aqueous $H_2SO_4$ solution having concentrations within the range of 80 to 90 weight percent prior to the nickel plating yields nickel-plated paper with lower electrical resistance and improved nickel adhesion to the fibrids in the paper. The improvement in both properties are very dramatic. The improvement in metal adhesion is also reflected in the appearance of the plated paper. The nickel films are very smooth within the 80 to 90 weight percent $H_2SO_4$ treatment, whereas those from contact with $H_2SO_4$ of the lower concentrations are very patchy and rough.

The T/E/M data show that the acid contact has some effect on the mechanical properties of aramid papers. The effect can be reduced by reducing the contact with the acid; and yet the dramatic improvement in electrical resistance and nickel adhesion can still be achieved. It should be noted that the nickel-plated paper, even with the 80 to 90 weight percent $H_2SO_4$ treatment, still remains flexible.

TABLE I

| $H_2SO_4$ (%) | Contact time (sec) | Nickel (%)* | Resistance (ohm) | Nickel adhesion (Tape test) | Paper Properties T/E/M(**) |
|---|---|---|---|---|---|
| Comparative examples: | | | | | |
| 0 | 0 | 0 | >30M*** | — | 25.7/10.8/483 |
| 30 | 15 | 10.3 | >30M | Nickel peeled | — |

TABLE I-continued

| $H_2SO_4$ (%) | Contact time (sec) | Nickel (%)* | Resistance (ohm) | Nickel adhesion (Tape test) | Paper Properties T/E/M(**) |
|---|---|---|---|---|---|
| | | | | off easily | |
| 30 | 30 | 14.8 | >30M | Same as above | — |
| 60 | 15 | 14.9 | >30M | " | |
| 60 | 30 | 15.6 | >30M | " | — |
| Examples: | | | | | |
| 80 | 15 | 22.0 | 823.9 | trace of nickel | — |
| 80 | 30 | 22.8 | 133.3 | " | — |
| 85 | 5 | 32.0 | 9.4 | No trace | 24.2/9.7/423 |
| 87.5 | 5 | 38.6 | 6.1 | " | 22.8/7.7/466 |
| 87.5 | 15 | 41.4 | 5.9 | " | 20.7/7.2/404 |
| 87.5 | 30 | 50.8 | 3.8 | " | |

*Weight percentage of nickel in the nickel-plated paper
**Tested on the acid-treated paper prior to metal plating
***M: million

EXAMPLE 2

Aqueous $H_2SO_4$ treatment: Pieces (~35 cm ~55 cm each) of meta-aramid paper (2 mil thick, containing 52 weight percent meta-aramid fibrids and 48 weight percent meta-aramid floc) were first contacted with $H_2SO_4$ as described for Example 1. The $H_2SO_4$ concentrations and contact times are listed in Table II.

Copper plating: The acid-contacted paper samples and one untreated piece were copper-plated according to the following steps:

1) Immersed in a palladium catalyst kept at 40° C. for 10 minutes. The palladium catalyst was made by mixing 540 g Shipley Co. CataprepR 404, 60 ml Shipley Co. CatapositR 44 and 1,700 ml deionized water to sensitize the fibrids.
2) The sensitized fibrids were then copper-plated in a copper-plating solution for 20 minutes kept at 40° C. The copper plating solution was made by mixing 1,476 ml deionized water, 240 ml Shipley Co. CircupositR 350M, 84 ml Shipley Co. CircupositR 3350A, and 200 ml Shipley Co. CircupositR 3350B.
3) The copper-plated fibrids were washed with water for about one and one-half hours. Water was changed twice. The thoroughly washed samples were then dried in a vacuum oven for about 24 hours. Each sample was weighed and the weights were compared with the weights prior to the copper plating for determination of copper weight percentage in each copper-plated sample.

The copper-plated samples were tested for electrical resistance, and copper adhesion to the paper substrate. The results are listed in Table II. The results show that the papers treated with an aqueous $H_2SO4$ solution having concentration within the range of 80 to 90 weight percent prior to the copper plating, yield copper-plated papers with dramatically improved copper adhesion to the fibrids in the paper. The dramatic improvement in metal adhesion is also reflected in the appearance of the plated papers. The copper films within the 80 to 90 weight percent $H_2SO_4$ treatment range are very smooth and shiny, whereas those from contact with $H_2SO_4$ of the lower concentration are patchy and rough.

TABLE II

| $H_2SO_4$ Conc. (%) | Contact time (sec) | Copper Resistance (%)* | Copper Resistance (ohm) | Copper adhesion (Tape test) |
|---|---|---|---|---|
| Comparative examples: | | | | |
| 0 | 0 | 12.9 | 0.335 | Copper peeled off easily |

TABLE II-continued

| $H_2SO_4$ Conc. (%) | Contact time (sec) | Copper Resistance (%)* | Copper Resistance (ohm) | Copper adhesion (Tape test) |
|---|---|---|---|---|
| 30 | 15 | 20.0 | 0.240 | Same as above |
| 30 | 30 | 24.2 | 0.185 | " |
| 60 | 15 | 23.7 | 0.196 | " |
| 70 | 15 | 25.5 | 0.152 | " |
| 75 | 15 | 26.9 | 0.201 | " |
| Examples: | | | | |
| 80 | 15 | 22.6 | 0.142 | No trace of copper |
| 80 | 30 | 23.6 | 0.124 | " |
| 85 | 5 | 37.0 | 0.053 | " |
| 87.5 | 5 | 39.4 | 0.048 | " |
| 87.5 | 15 | 36.0 | 0.056 | " |
| 87.5 | 30 | 38.3 | 0.055 | " |

*Weight percentage of copper in the copper-plated paper

I claim:

1. In a process for electrolessly plating aramid fibrids with a durable metal coating comprising the steps of contacting the fibrids to be plated with a sensitizing solution, rinsing the fibrids, and immersing the fibrids in a solution of metal cations to be plated;

the improvement which comprises, (a) contacting the aramid fibrids with an aqueous solution consisting essentially of 80 to 90% sulfuric acid for 2 to 60 seconds at a temperature in the range from 10° to 100° C.; and (b) washing the acid-contacted fibrids with water until substantially all of the acid is removed, before contacting the fibrids to be plated with the sensitizing solution.

2. The process of claim 1 wherein the aqueous solution consists essentially of 80–88% sulfuric acid, the temperature is in the range of 20° to 40° C., and the contact time is from 5 to 30 seconds.

3. The process of claim 1 or 2 wherein said fibrids are included in a sheet.

4. The process of claim 1 or 2 wherein there is the added step of:

(c) drying the washed fibrids.

5. The process of claim 4 wherein the drying is conducted at 15°–80° C.

6. The process of claim 1 or 2 wherein the durable metal is copper, nickel, silver, or cobalt.

7. A process for plating aramid fibrids with a durable metal coating comprising the steps of:

a) contacting aramid fibrids with an aqueous solution consisting essentially of 80 to 90% sulfuric acid for 2 to 60 seconds at a temperature in the range from 10° to 100° C.;

b) washing the acid-contacted fibrids with water until substantially all of the acid is removed;

c) contacting the washed fibrids with a sensitizing solution;

d) rinsing the fibrids to remove nonadherent sensitizing solution; and e) immersing the rinsed fibrids in an aqueous solution of metal cations to be plated.

8. The process of claim 7 wherein the aqueous solution consists essentially of 80–88% sulfuric acid, the temperature is in the range of 20° to 40° C. and the contact time is from 5 to 30 seconds.

9. The process of claim 7 or 8 wherein said fibrids are included in a sheet.

10. The process of claim 7 or 8 wherein the metal cation to be plated is selected from the group consisting of copper, nickel, silver, and cobalt.

11. The process of claim 7 or 8 wherein there is the added step of:

drying the washed fibers after the washing of step (b).

12. The process of claim 11 wherein the drying is conducted at 15°–80° C.

* * * * *